US007774888B2

(12) United States Patent
Chen

(10) Patent No.: US 7,774,888 B2
(45) Date of Patent: Aug. 17, 2010

(54) CHILD'S MUSIC-PLAYING TOOTHBRUSH CONFIGURED FOR ATTRACTIVE DISPLAY OF GRAPHICS AND IMPROVED SOUND QUALITY

(75) Inventor: Barnabas C. Chen, Chino Hills, CA (US)

(73) Assignee: World Trend, Inc.

( * ) Notice: Subject to any disclaimer, the term of this patent is extended or adjusted under 35 U.S.C. 154(b) by 39 days.

(21) Appl. No.: 11/788,621

(22) Filed: Apr. 19, 2007

(65) Prior Publication Data

US 2008/0256730 A1 Oct. 23, 2008

(51) Int. Cl.
*A46B 9/04* (2006.01)
*A46B 15/00* (2006.01)

(52) U.S. Cl. ..... 15/105; 15/143.1; 15/167.1

(58) Field of Classification Search ..... 15/105, 15/167.1, 143.1
See application file for complete search history.

(56) References Cited

U.S. PATENT DOCUMENTS 5,044,037 A * 9/1991 Brown ..... 15/105
5,133,102 A * 7/1992 Sakuma ..... 15/167.1
5,259,086 A * 11/1993 Fong ..... 15/105
5,339,479 A 8/1994 Lyman
5,572,762 A 11/1996 Scheiner
D397,872 S * 9/1998 Moskovich et al. ..... D4/104
5,924,159 A * 7/1999 Haitin ..... 15/105
6,202,245 B1 3/2001 Khodadadi
6,308,365 B1 * 10/2001 Huang ..... 15/106
D505,264 S * 5/2005 Chen ..... D4/104
2001/0034917 A1 * 11/2001 DuCey ..... 15/167.1
2005/0172433 A1 * 8/2005 Oliver et al. ..... 15/105
2005/0278882 A1 * 12/2005 Drzewiecki et al. ..... 15/105
2007/0074359 A1 * 4/2007 O'Lynn ..... 15/105
2008/0028553 A1 * 2/2008 Batthauer ..... 15/105

* cited by examiner

*Primary Examiner*—Randall Chin
(74) *Attorney, Agent, or Firm*—Leonard Tachner

(57) ABSTRACT

A music-playing toothbrush having a hollow handle housing containing suitable solid state electronic components for selectively playing a musical tune with improved sound quality. The sound quality is expressly addressed in the handle design with an interior sealed speaker enclosure configured to direct the sound toward the listener with little internal leakage and with an undulating violin-like cavity shape that suppresses internal standing waves. Moreover, the handle provides a relatively large, relatively flat, substantially uninterrupted surface for receiving attractive and motivational graphics such as licensed cartoon characters, which may be compatible with the musical selection.

4 Claims, 3 Drawing Sheets

CHILD'S MUSIC-PLAYING TOOTHBRUSH CONFIGURED FOR ATTRACTIVE DISPLAY OF GRAPHICS AND IMPROVED SOUND QUALITY

BACKGROUND OF THE INVENTION

1. Field of the Invention

The present invention relates generally to a music or other audio-playing toothbrush especially suited to motivating children to brush their teeth. The invention herein pertains more specifically to such a child's toothbrush having a handle exterior that provides a relatively uninterrupted surface for displaying graphics related to such music or other audio. The invention also provides a unique handle interior design which provides a speaker enclosure for improving sound quality.

2. Background Art

The general concept of a toothbrush having a handle for producing sound is not new. For example, U.S. Pat. No. 5,339,479 to Lyman; U.S. Pat. No. 5,572,762 to Scheimer; U.S. Pat. No. 6,202,245 to Khodadadi; and Published Patent Application No. 2005/0278882 to Drzewiecki et al; all disclose such toothbrushes. All of these prior art toothbrushes have the same general purpose of motivating daily extended brushing of the teeth, especially by children who would be most attracted and influenced by a toothbrush that plays a recognizable musical tune and has compatible graphics such as related cartoon characters and the like. Unfortunately, none of the aforementioned patents and applications disclose configurations which provide a suitable handle surface for displaying such graphics or disclose or suggest a handle capable of producing superior sound fidelity.

In regard to a suitable handle surface for displaying graphics, handles which are generally of round cylindrical shape are not preferred because they are more difficult to apply graphics or print on, they tend to distort the images and the curved surface does not permit all of the graphics to be directed uniformly in a packaged configuration. Moreover, toothbrush handles that have interrupted surfaces to accommodate electric switches or other functional elements such as removable compartments, do not provide suitable surfaces for receiving graphics. Furthermore, conventional size, narrow handle surfaces do not afford sufficient surface area to place meaningful or appropriate size graphics.

The sound quality in such prior art sound producing toothbrushes, has not been adequately addressed either. Simply providing a tiny sound transducer that is sufficiently small to be received inside the toothbrush handle will not produce good quality sound to provide an attractive and recognizable tune sufficient to motivate a child to brush his or her teeth. Poor quality sound can become more of an annoyance and a deterrence than no sound at all.

Thus, despite the prior art attempts to teach a motivational music-playing toothbrush, there is still an ongoing need for such an invention that overcomes the noted deficiencies.

SUMMARY OF THE INVENTION

The present invention is specifically designed to overcome the noted deficiencies of the prior art. It provides in its preferred embodiment described herein, a music-playing toothbrush having a hollow handle housing containing suitable solid state electronic components for selectively playing a musical tune with improved sound quality. The sound quality is expressly addressed in the handle design with an interior sealed speaker enclosure configured to direct the sound toward the listener with little internal leakage and with an undulating violin-like cavity shape that suppresses internal standing waves. Moreover, the handle provides a relatively large, relatively flat, substantially uninterrupted surface for receiving attractive and motivational graphics such as licensed cartoon characters, which may be compatible with the musical selection.

BRIEF DESCRIPTION OF THE DRAWINGS

The aforementioned objects and advantages of the present invention, as well as additional objects and advantages thereof, will be more fully understood herein after as a result of a detailed description of a preferred embodiment when taken in conjunction with the following drawings in which.

DETAILED DESCRIPTION OF A PREFERRED EMBODIMENT

Figure 1:
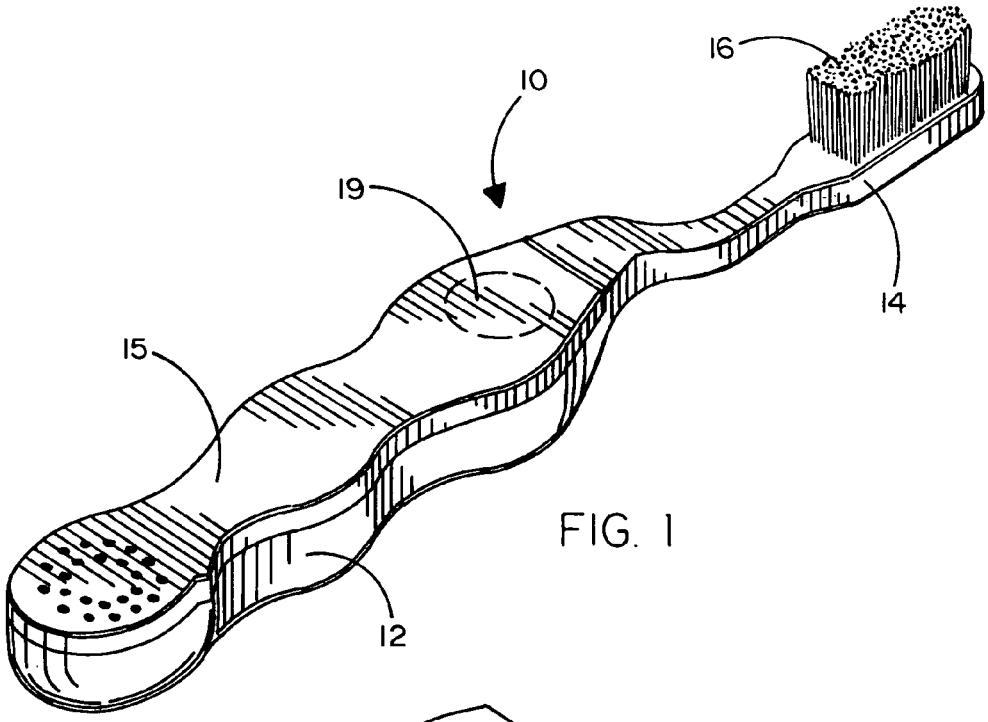
FIG. 1 is a three-dimensional view of a fully assembled preferred embodiment of the invention.
Figure 2:
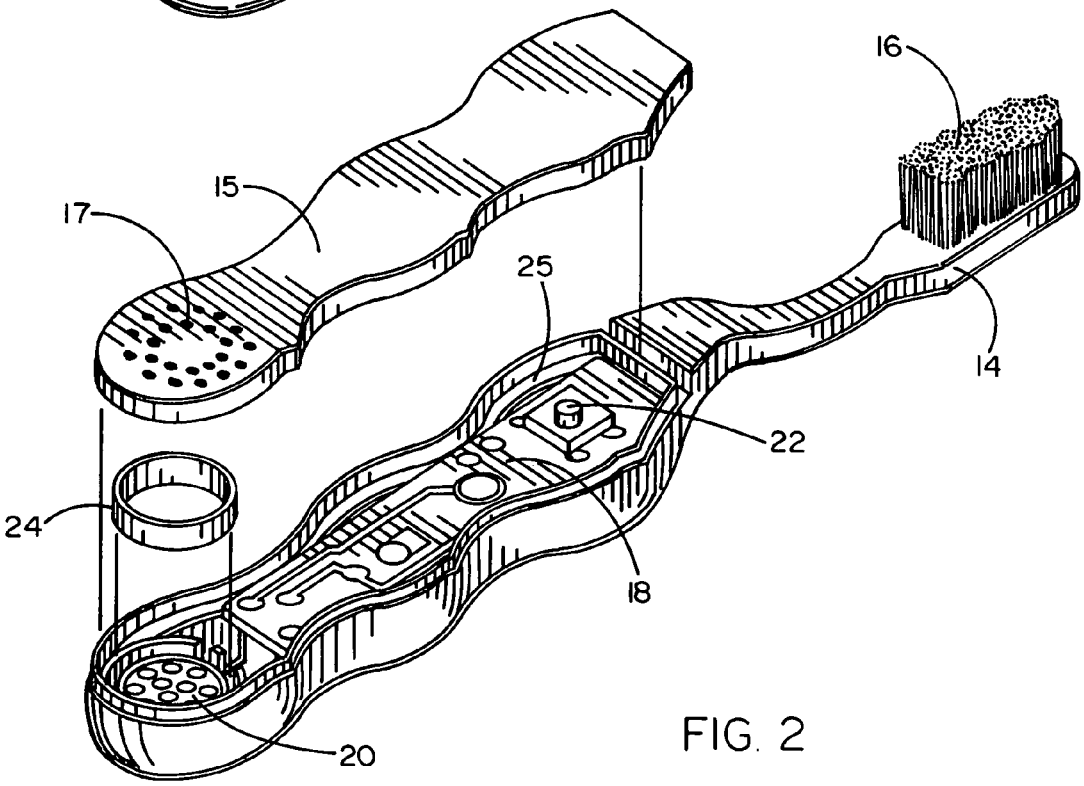
FIG. 2 is a partially exploded view of the music-playing toothbrush of FIG. 1.
Figure 3:
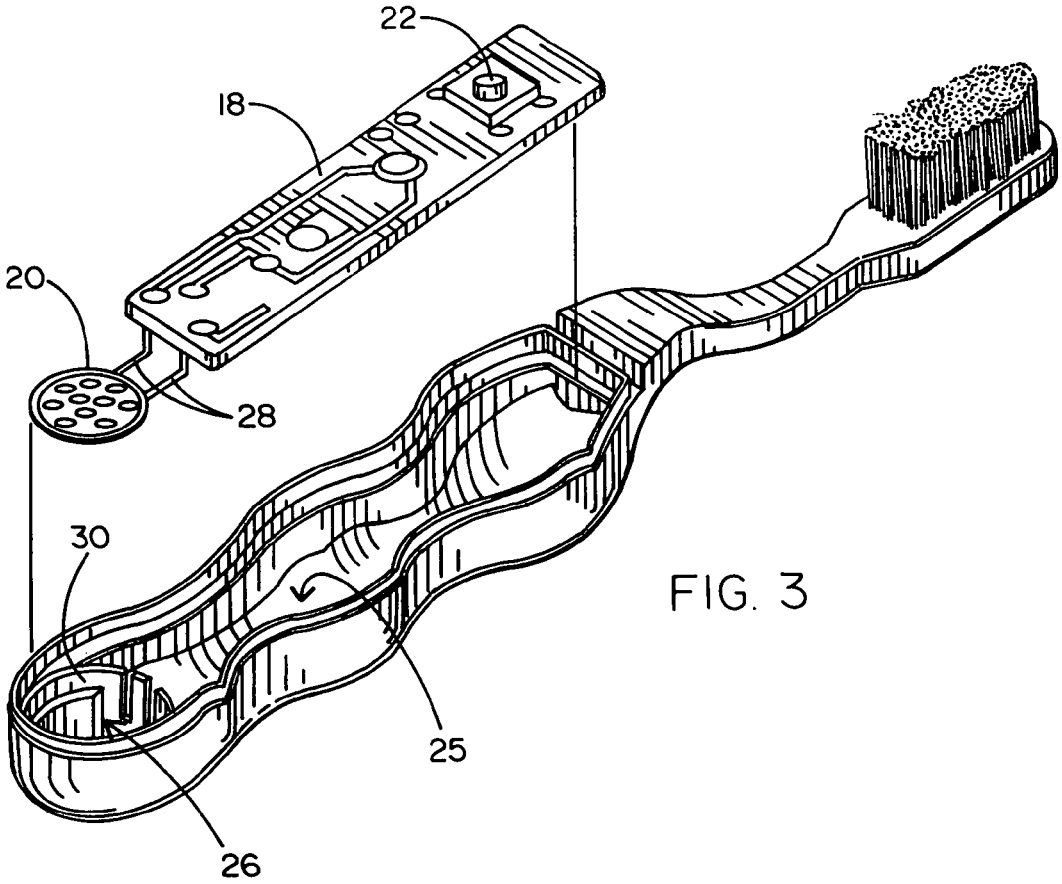
FIG. 3 is a further partial exploded view of the toothbrush of FIG. 1.
Figure 4:
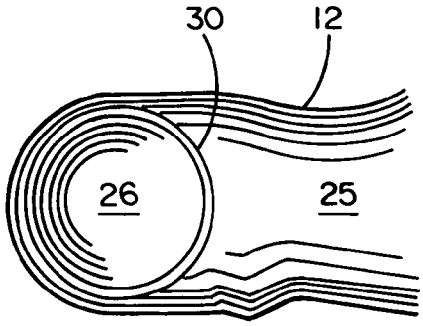
FIG. 4 is an elevational view of the speaker chamber of the preferred embodiment.
Figure 5:
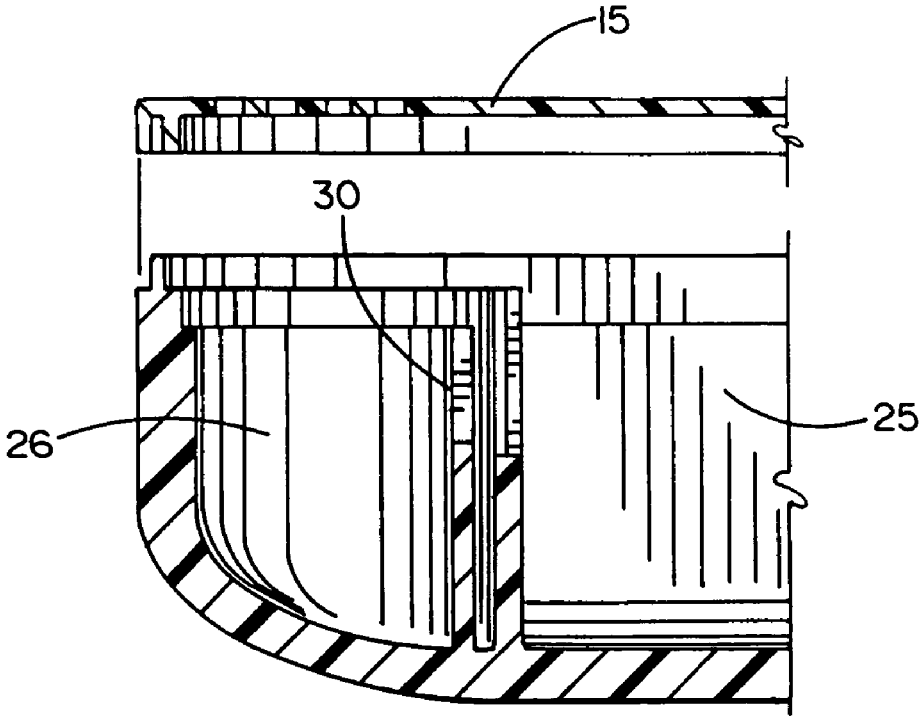
FIG. 5 is a side cross-sectional view of the speaker chamber of FIG. 4.

Referring to the accompanying drawings and initially to FIGS. 1-3 in particular, it will be seen that a music-playing toothbrush 10 comprises a handle portion 12 and a bristle portion 14, the latter having extending bristles 16 as in conventional toothbrushes.

The handle portion 12 is characterized by a graphics surface cover 15 which as can be seen best in FIGS. 1 and 2, is substantially flat and uninterrupted except for a plurality of small speaker holes 17 at the terminal end of the cover 15. A softened membrane area 19, closer to the opposite end of the handle portion, is shown in dotted lines in FIG. 1 to identify its location. However, area 19 does not interrupt the graphics surface cover 15 and is not substantially apparent except by tactile contact which would be perceived as a slight rise or bump in cover 15. The length and width of cover 15 are selected to provide a substantial size, relatively flat and uninterrupted surface to receive graphics such as colorful cartoon characteristics or the like. In the preferred embodiment, the graphics are selected to be compatible with the nature of the music or tune to be played. In addition, the handle portion 12 may preferably have undulations along the side surface to provide a finger-grasping shape for a child's hand. The cover 15 is preferably shaped accordingly to accommodate such undulations as shown in FIGS. 1 and 2.

Figure 6:
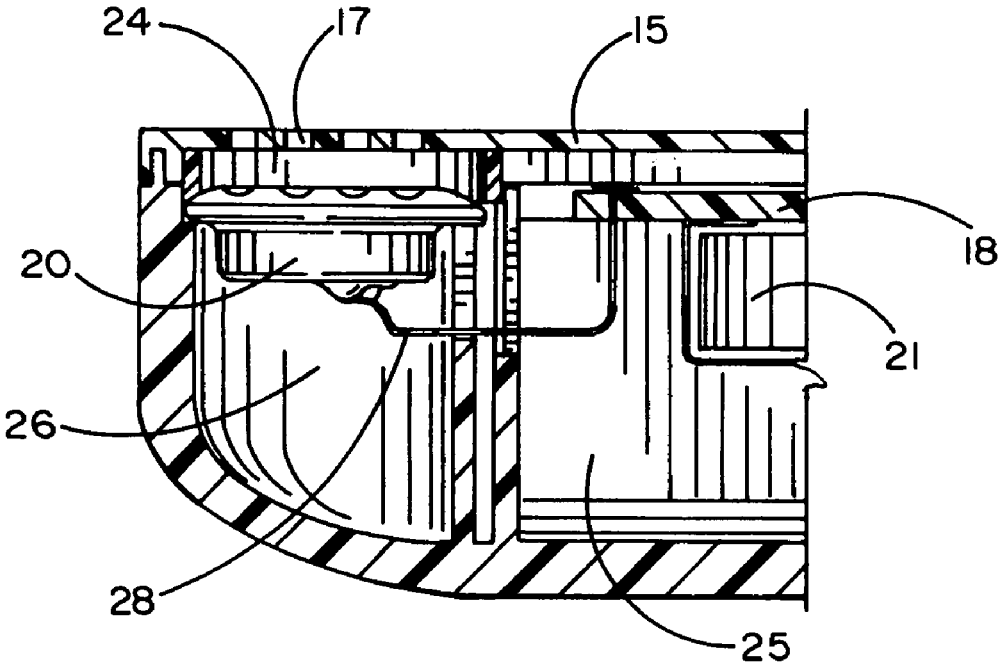
FIG. 6 is a view similar to FIG. 5, but with the speaker and other components shown installed.

As seen in FIGS. 2 and 3, cover 15 encloses an interior chamber 25 within which is mounted a printed circuit board (PCB) 18 and a speaker enclosure 26 within which is mounted a small speaker or audio transducer 20. PCB 18 has all of the electrical components which are employed to store about two minutes of music in a digital signal format and convert it to an analog form upon activation by a switch 22 through membrane 19 of cover 15. The analog signal is fed to speaker 20 via a pair of wires 28 as shown best in FIGS. 3 and 6. At least one battery 21 is provided on PCB 18 or otherwise within interior chamber 25 as shown herein in FIG. 6.

Referring now to FIGS. 2 to 6, it will be observed that speaker enclosure 26 is immediately adjacent interior chamber 25, but segregated from the chamber by a wall 30. Moreover, as shown in FIG. 2, an annular seal 24 is preferably provided to further isolate the speaker 20 within the enclosure 26 from the remaining interior chamber 25.

In this way, speaker 20 is effectively provided with its own segregated enclosure much like a conventional size speaker enclosure used in stereo systems and other high fidelity audio environments. The result is a much improved level of audio quality as compared to simply including speaker 20 within the same general interior chamber 26 that holds PCB 18 within the handle portion 12.

The sound transducer has been mounted in such a way as to acoustically embody an infinite baffle design to prevent sound wave phase cancellation at the listener's ear by elimination of the forward projected portion of the transducer's rearward radiated sound by means of a peripheral sealing of the transducer to the exterior graphic bearing faceplate. This is accomplished through the use of an "O" ring to facilitate manufacturing process, but also includes all other means to carry out the same function including, but not limited to the use of an adhesive bead, sealing compound bead or through clamping of the periphery of the transducer by the means of either the case/lid interface or another separate ring (but not necessarily a generic "O" ring) shaped part. The advantage of the "O" ring sealing is that its resilience takes up or relieves manufacturing tolerance inconsistencies from using different third party transducer purchases that would impose a retooling requirement for any batch changes in commercially available transducer dimensions if clamping/sealing were to be accomplished through the use of incorporating an injection molded clamp/seal design being part of the case and lid interface. The "O" ring also has the advantage of providing some shock resistance for the transducer during the inevitable drops and impacts that the invention will suffer at the hand of children in use.

Another advantage that the transducer installation relates more to the assembled case/enclosure; the rear porting of the small transducer mounting cavity (through the slotted openings which accommodate the electrical wiring to the transducer from the pc board) to acoustically couple with the shaped cavity (handle) which also encloses the pc board. The inclusion of the internally rear-ported resonant cavity design enhances and reinforces the listener received sound by means of changing the rearward acoustical impedance experienced by the transducer.

The design of the internal resonant cavity containing the pc board which can be viewed as accommodation for the necessary exterior shell finger relief/hand palm shape comfort, includes an intrinsic acoustical design. The internal cavity shape incorporates sound enhancing features that are unique and result in a purity and diffusion of sound that counteracts standing wave amplification of specific tones. This sound enhancement is obtained by means of an undulating, non-parallel walled cavity design. While the top of the cavity is formed by the flat cover, all the rest of the interior incorporates a violin shape design that suppresses internal standing waves and results in a more pleasing radiated sound, free from specific resonant peaks that would be heard as harshness and a lack of musical quality.

Thus it will be seen that the present music-playing child's toothbrush has at least two unique and highly advantageous features that relate to motivating a child to use the toothbrush hereof and thus promotes a healthy habit of frequent brushing of the teeth. One such feature is the unique graphics receiving surface provided by cover 15. This surface is sufficiently large in area and sufficiently flat in shape and uninterrupted in structure to provide a graphics receiving surface which can be big, bright and colorful enough to attract a child. Moreover, it is easy to apply and adhere or print graphics to such a surface making it less costly to fabricate and more likely to attract licensors of copyrighted cartoon characters that would be recognized by children.

The other such feature is a unique speaker enclosure within the handle portion interior and which serves to improve the sound quality, loudness and fidelity of the music so that it is more likely to be recognized and pleasantly received by a child. Moreover, by improving the quality of the sound emanating from the interior of the music-playing toothbrush of the invention, it becomes more feasible to make the graphics and music more compatible and thus more likely to relate to a recognizable common theme that will attract and thus motivate a child to brush his or her teeth.

Having thus disclosed a preferred embodiment of the present invention, it will now be understood that many additions and modifications may be made to the described embodiment. Therefore, it will be understood that the scope hereof is not necessarily limited by the particular version shown herein, but should instead be deemed more broadly defined by the appended claims and their equivalents.

I claim:

1. A music-playing toothbrush comprising:

an elongated handle forming a hollow chamber within said handle and extending to a first end of said toothbrush;

a bristle-bearing surface extending to a second end of said toothbrush;

said elongated handle forming a majority of the overall length of said toothbrush;

said chamber being enclosed by a substantially flat, graphics-bearing, removable cover surface extending the length and width of said handle and having at least one opening for emitting musical sound therethrough;

said chamber having an audio transducer for generating said musical sound and an undulating interior surface in opposed relation to said cover surface for suppressing standing audio waves from said audio transducer; and said audio transducer being located in an enclosure segregated from a remainder of said chamber and being isolated by an annular seal.

2. The music-playing toothbrush recited in claim 1 wherein said cover surface has a maximum width that is at least twice the width of said bristle-bearing surface.

3. The music-playing toothbrush recited in claim 1 wherein said chamber cover surface lies in a plane that is substantially parallel to said bristle-bearing surface.

4. The music-playing toothbrush recited in claim 1, said chamber receiving electronic components for generating music.

* * * * *